US007051629B2

(12) United States Patent
Huang

(10) Patent No.: US 7,051,629 B2
(45) Date of Patent: May 30, 2006

(54) TOOL HANDLE ADJUSTABLE TO DIFFERENT LENGTH

(76) Inventor: Yung Hsu Huang, P.O.Box 63-99, Taichung (TW) 406

( * ) Notice: Subject to any disclaimer, the term of this patent is extended or adjusted under 35 U.S.C. 154(b) by 98 days.

(21) Appl. No.: 10/896,447

(22) Filed: Jul. 23, 2004

(65) Prior Publication Data

US 2006/0016301 A1 Jan. 26, 2006

(51) Int. Cl.
*B25G 1/08* (2006.01)

(52) U.S. Cl. ..... 81/489; 81/177.4; 81/490; 81/438

(58) Field of Classification Search ..... 81/489, 81/177.4, 177.1, 490, 438–439
See application file for complete search history.

(56) References Cited

U.S. PATENT DOCUMENTS 4,227,430 A * 10/1980 Jansson et al. ..... 81/177.4
5,601,003 A 2/1997 Amtenbrink et al. ..... 81/489
5,868,048 A * 2/1999 Cassutti et al. ..... 81/439
5,899,127 A * 5/1999 Shiao ..... 81/490
6,070,503 A 6/2000 Shiao ..... 81/63.2
6,076,440 A * 6/2000 Hsu ..... 81/490
6,186,036 B1 * 2/2001 Huang ..... 81/490
6,237,451 B1 * 5/2001 Wei ..... 81/490
6,324,946 B1 * 12/2001 Gasser et al. ..... 81/121.1
6,502,484 B1 * 1/2003 Pao-Hsi ..... 81/439

* cited by examiner

*Primary Examiner*—Lee D Wilson

(57) ABSTRACT

A tool handle includes a handle member having a shank for driving tool members, and having a barrel. A primary hand grip includes a space to receive the barrel, and to attach the primary hand grip to the barrel. An auxiliary hand grip includes a stem selectively engageable into the barrel, to selectively attach the auxiliary hand grip to the barrel of the handle member, and to increase a length of the tool handle by combining both the auxiliary hand grip and the primary hand grip together, and the auxiliary hand grip may be selectively detached from the barrel of the handle member, to decrease the length of the tool handle to only the primary hand grip.

15 Claims, 4 Drawing Sheets

TOOL HANDLE ADJUSTABLE TO DIFFERENT LENGTH

BACKGROUND OF THE INVENTION

1. Field of the Invention

The present invention relates to a tool handle, and more particularly to a tool handle having an adjustable structure for allowing the tool handle to be adjusted to different length.

2. Description of the Prior Art

Typical tool handles, such as tool handles for screw drivers, comprise a driving shank attached or secured to a hand grip, for allowing the driving shank to be rotated or driven by the hand grip. Normally, the hand grip of the typical tool handles comprise a predetermined length that may not be adjusted to different lengths, and thus may not be suitably rotated or driven by palms of users of different sizes or areas.

For example, U.S. Pat. No. 5,601,003 to Amtenbrink et al. discloses one of the typical tool handles comprise a hand grip also having a predetermined length that may not be adjusted to different lengths, such that the typical tool handle also may not be suitably rotated or driven by palms of users of different sizes or areas.

U.S. Pat. No. 6,070,503 to Shiao discloses another typical tool handle comprising a hand grip having a cavity formed therein for receiving a ratchet driving mechanism therein. Similarly, the tool handle also includes a predetermined length that may not be adjusted to different lengths, such that the typical tool handle also may not be suitably rotated or driven by palms of users of different sizes or areas.

The present invention has arisen to mitigate and/or obviate the afore-described disadvantages of the conventional tool handles.

SUMMARY OF THE INVENTION

The primary objective of the present invention is to provide a tool handle including an adjustable structure for allowing the tool handle to be adjusted to different length.

In accordance with one aspect of the invention, there is provided a tool handle comprising a handle member including a shank extended forwardly therefrom, for engaging with and for driving tool members, and including a barrel extended rearwardly therefrom and having a bore formed therein, a primary hand grip including a space formed therein to receive the barrel, and to attach the primary hand grip to the barrel, and an auxiliary hand grip including a stem extended therefrom, and selectively engageable into the bore of the barrel, to selectively attach the auxiliary hand grip to the barrel of the handle member, and to increase a length of the tool handle by combining both the auxiliary hand grip and the primary hand grip together, and the auxiliary hand grip being selectively detachable from the barrel of the handle member, to decrease the length of the tool handle to only the primary hand grip.

The barrel includes a non-circular outer peripheral portion formed thereon, and the space of the primary hand grip includes a non-circular cross section corresponding to that of the barrel, to stably attach the primary hand grip to the barrel, and to prevent the primary hand grip from being rotated relative to the handle member.

The barrel includes an outer diameter smaller than that of the handle member, to form a peripheral shoulder between the barrel and the handle member, the primary hand grip includes a front portion engageable with the peripheral shoulder of the barrel, to solidly attach the primary hand grip to the barrel of the handle member.

The bore of the barrel includes a non-circular cross section, and the stem of the auxiliary hand grip includes a non-circular cross section corresponding to that of the bore of the barrel, to allow the auxiliary hand grip to be solidly attached to the barrel of the handle member, and to prevent the auxiliary hand grip from being rotated relative to the handle member.

The auxiliary hand grip includes a spring member attached to the stem, and engageable with the barrel, to stably attach the auxiliary hand grip to the barrel of the handle member. The spring member includes a peripheral wall engaged onto the stem, to stably attach the spring member to the stem of the auxiliary hand grip.

The stem includes at least one outer peripheral groove formed therein, and the spring member includes a peripheral rib extended inwardly from the peripheral wall and engaged into the outer peripheral groove of the stem, to stably attach the spring member to the stem of the auxiliary hand grip.

The auxiliary hand grip includes an outer peripheral fence extended therefrom, and located around the stem, to form a peripheral recess between the outer peripheral fence and the stem, and to receive the barrel and the primary hand grip.

The primary hand grip includes a peripheral flange extended rearwardly therefrom, and having an outer diameter smaller than that of the primary hand grip, to form a peripheral shoulder between the peripheral flange and the primary hand grip, the peripheral flange is engaged into the peripheral recess of the auxiliary hand grip, and the outer peripheral fence of the auxiliary hand grip is engaged into the peripheral shoulder of the primary hand grip.

The auxiliary hand grip includes a chamber formed therein, and a tool holder received in the chamber of the auxiliary hand grip. The tool holder includes a plurality of orifices formed therein, for receiving tool members therein. The tool holder includes a plurality of slits formed therein, and communicating with the orifices thereof, to resiliently clamping and retaining the tool members to the tool holder.

The tool holder includes a spring member engaged thereon to clamp and retain the tool members to the tool holder. The tool holder includes an outer peripheral slot formed therein, to receive the spring member. The auxiliary hand grip includes a cover attached thereto, to enclose the chamber thereof, and to stably retain the tool holder in the chamber of the auxiliary hand grip.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
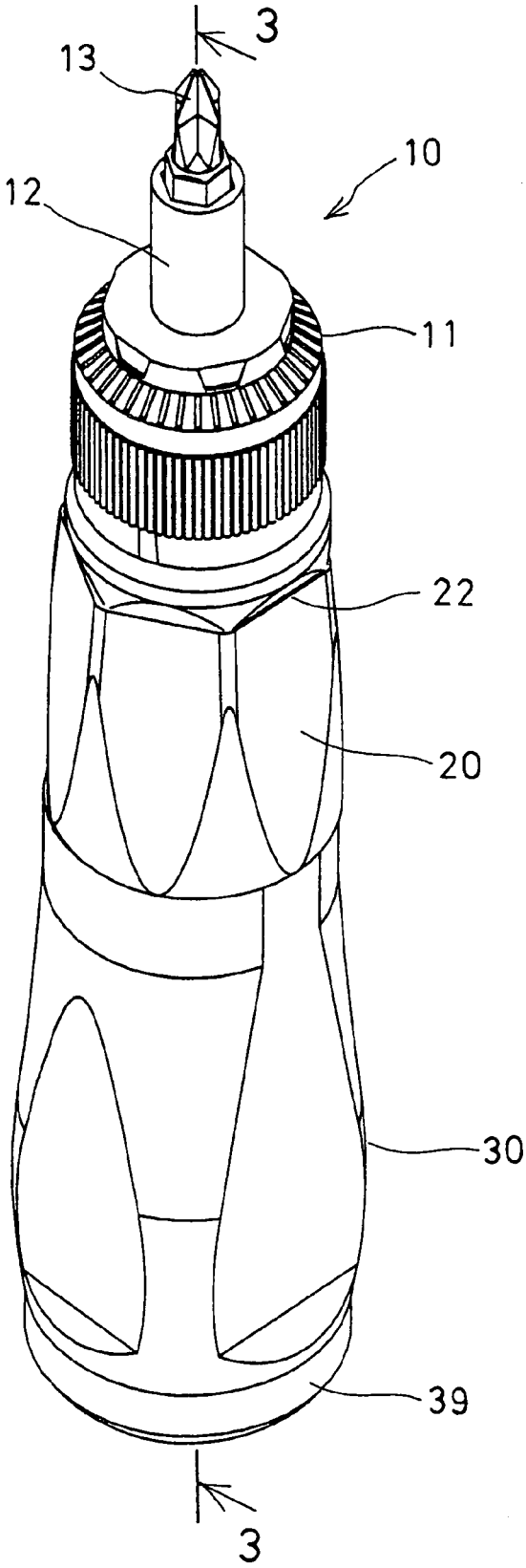
FIG. 1 is a perspective view of a tool handle in accordance with the present invention.
Figure 2:
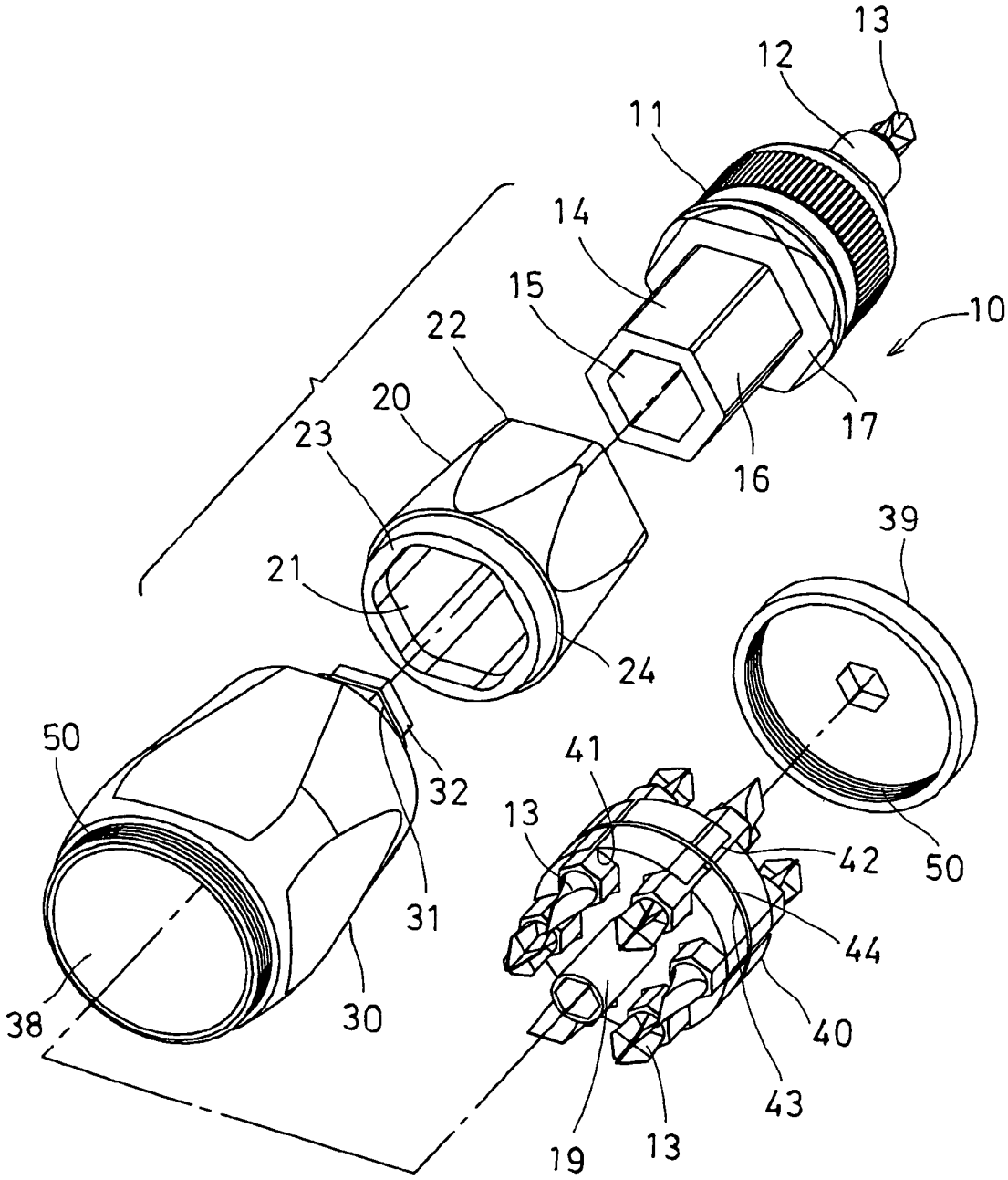
FIG. 2 is an exploded view of the tool handle.
Figure 3:
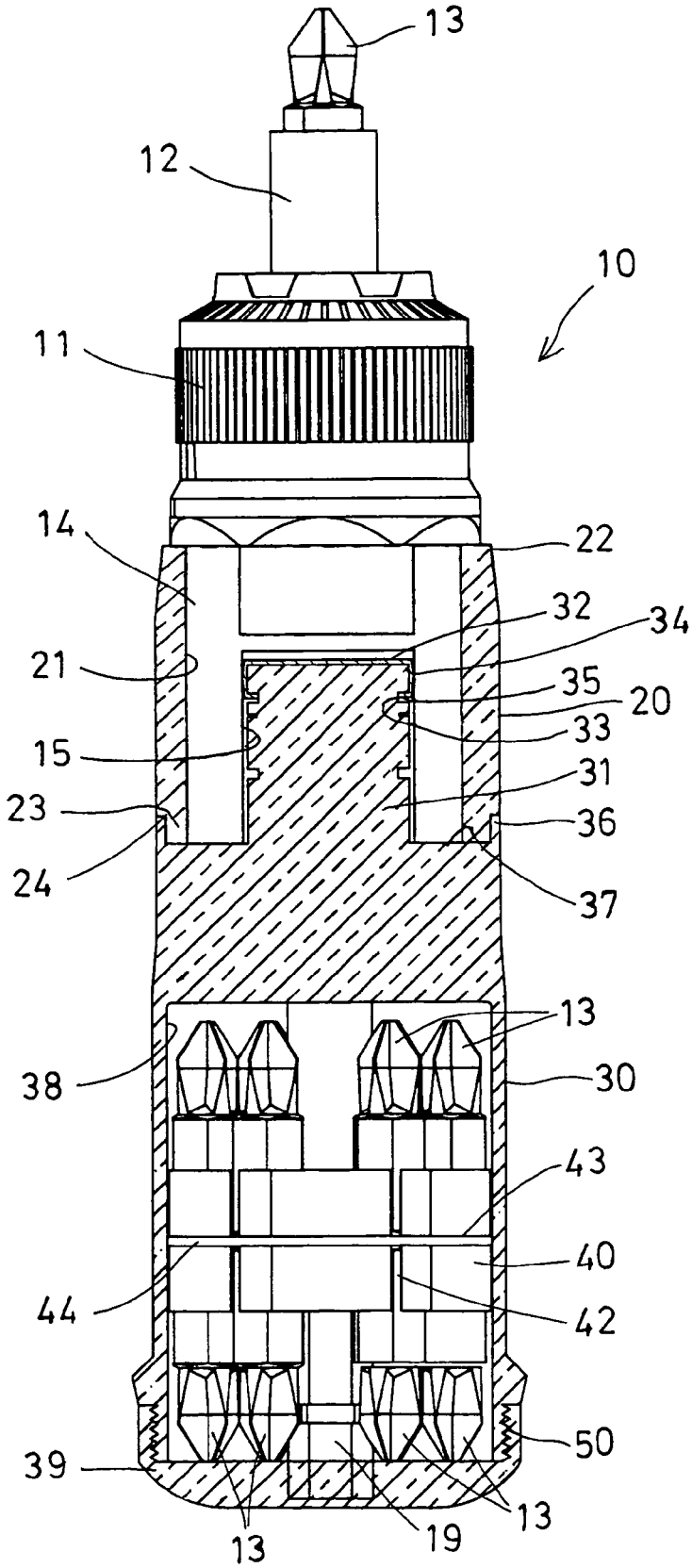
FIG. 3 is a cross sectional view of the tool handle, taken along lines 3—3 of FIG. 1.

Referring to the drawings, and initially to FIGS. 1–3, a tool handle 10 in accordance with the present invention comprises a handle body or handle member 11 including a shank 12 extended forwardly therefrom, for engaging with or for attaching a tool member 13 thereto, such as a screw driver bit 13, a tool extension 19 (FIG. 3), or the like.

The tool member 13 may be rotated or driven by the handle body or the handle member 11 via the shank 12. The handle body or handle member 11 may include a ratchet driving mechanism disposed therein (not shown), for driving the tool member 13 in an active direction, and for allowing the tool member 13 to be rotated freely relative to the handle body or the handle member 11 in a reverse direction.

The handle body or handle member 11 includes a tube or barrel 14 extended rearwardly therefrom and having a bore 15 formed therein, and preferably having a non-circular cross section, such as a hexagonal cross section as shown in FIG. 2. It is preferable that the barrel 14 includes a non-circular outer peripheral portion 16 formed thereon and having an outer diameter smaller than that of the handle member 11, to form a peripheral shoulder 17 between the barrel 14 and the handle member 11.

A base or primary handle section or hand grip 20 includes a space 21 formed therein, and having a non-circular cross section corresponding to that of the outer peripheral portion 16 of the barrel 14, and includes a front portion 22 engageable with the peripheral shoulder 17 of the barrel 14, to allow the primary hand grip 20 to be solidly attached to the barrel 14 of the handle member 11, and to prevent the primary hand grip 20 from being rotated relative to the handle member 11.

The primary hand grip 20 includes an annular or peripheral flange 23 extended rearwardly therefrom, and having an outer diameter smaller than that of the primary hand grip 20, to form a peripheral shoulder 24 between the peripheral flange 23 and the primary hand grip 20. It is preferable that the primary hand grip 20 is made of transparent or semi-transparent materials, for allowing the barrel 14 to be seen through the primary hand grip 20.

An auxiliary handle section or hand grip 30 includes a stem 31 extended therefrom, and engageable into the bore 15 of the barrel 14, and having a non-circular cross section corresponding to that of the bore 15 of the barrel 14, to allow the auxiliary hand grip 30 to be solidly attached to the barrel 14 of the handle member 11, and to prevent the auxiliary hand grip 30 from being rotated relative to the handle member 11.

A spring member 32 is attached to a free end portion of the stem 31, and engageable with the barrel 14, for solidly or stably attach or secure the auxiliary hand grip 30 to the barrel 14 of the handle member 11. For example, the stem 31 includes one or more outer peripheral grooves 33 formed therein, and the spring member 32 includes a peripheral wall 34 engaged onto the stem 31, and a peripheral rib 35 extended inwardly from the peripheral wall 34 and engaged into either of the outer peripheral grooves 33 of the stem 31, to solidly or stably attach or secure the spring member 32 to the stem 31 of the auxiliary hand grip 30.

The auxiliary hand grip 30 further includes an outer peripheral fence 36 extended therefrom, and arranged or located around the stem 31, to form or define a peripheral recess 37 between the outer peripheral fence 36 and the stem 31, and to receive the barrel 14 and the peripheral flange 23 of the primary hand grip 20, and thus to further stably anchor or secure the auxiliary hand grip 30 to the barrel 14 of the handle member 11, and to the primary hand grip 20.

Figure 4:
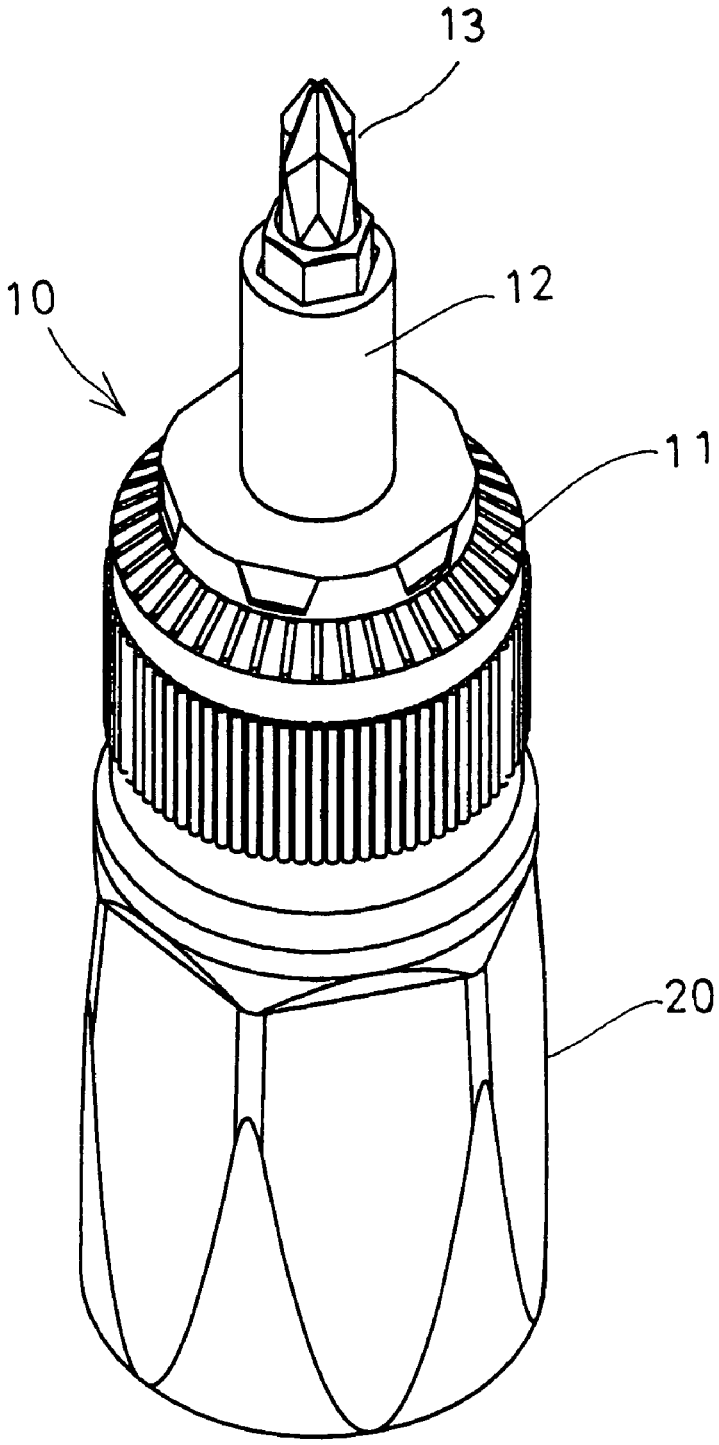
FIG. 4 is a perspective view illustrating the operation of the tool handle, having an auxiliary hand grip removed or detached from a base or primary hand grip.

In operation, as shown in FIGS. 1 and 3, the auxiliary hand grip 30 may be selectively attached or secured to the barrel 14 of the handle member 11 and to the primary hand grip 20, to allow the tool handle 10 to have a length combined by both the auxiliary hand grip 30 and the primary hand grip 20. As shown in FIG. 4, the auxiliary hand grip 30 may also be detached or disengaged from the primary hand grip 20, to reduce the length of the tool handle 10 to only the primary hand grip 20.

Accordingly, the tool handle 10 may include a longer length combined by both the auxiliary hand grip 30 and the primary hand grip 20, or a shorter length of only the primary hand grip 20, to allow the tool handle 10 to be suitably grasped or held by palms of users having different sizes or areas, and to allow the tool handle 10 to be suitably rotated or driven by the users in different working environments.

The auxiliary hand grip 30 further includes a chamber 38 formed therein, to receive a tool holder 40 therein, and a cover 39 attachable to the auxiliary hand grip 30 with such as a threading engagement 50, in order to enclose the chamber 38 thereof, and to stably retain the tool holder 40 within the chamber 38 thereof, and to prevent the tool holder 40 from being disengaged from the auxiliary hand grip 30.

The tool holder 40 includes a number of orifices 41 formed therein for receiving the tool members 13, such as the screw driver bits 13, the tool extensions 19, or the like, and includes a number of slits 42 formed therein and communicating with the orifices 41 thereof, for resiliently clamping or retaining the tool members 13 to the tool holder 40. The tool holder 40 may further include an outer peripheral slot 43 formed therein, to receive a spring member 44 which may further be used to stably and resiliently clamp or retain the tool members 13 to the tool holder 40.

Accordingly, the tool handle in accordance with the present invention includes an adjustable structure for allowing the tool handle to be adjusted to different length.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle comprising:

a handle member including a shank extended forwardly therefrom, for engaging with and for driving tool members, and including a barrel extended rearwardly therefrom and having a bore formed therein, a primary hand grip including a space formed therein to receive said barrel, and to attach said primary hand grip to said barrel, and an auxiliary hand grip including a stem extended therefrom, and selectively engageable into said bore of said barrel, to selectively attach said auxiliary hand grip to said barrel of said handle member, and to increase a length of said tool handle by combining both said auxiliary hand grip and said primary hand grip together, and said auxiliary hand grip being selectively detachable from said barrel of said handle member, to decrease the length of said tool handle to only said primary hand grip.

2. The tool handle as claimed in claim 1, wherein said barrel includes a non-circular outer peripheral portion formed thereon, and said space of said primary hand grip includes a non-circular cross section corresponding to that of said barrel, to stably attach said primary hand grip to said barrel, and to prevent said primary hand grip from being rotated relative to said handle member.

3. The tool handle as claimed in claim 1, wherein said barrel includes an outer diameter smaller than that of said handle member, to form a peripheral shoulder between said barrel and said handle member, said primary hand grip includes a front portion engageable with said peripheral shoulder of said barrel, to solidly attach said primary hand grip to said barrel of said handle member.

4. The tool handle as claimed in claim 1, wherein said bore of said barrel includes a non-circular cross section, and said stem of said auxiliary hand grip includes a non-circular cross section corresponding to that of said bore of said barrel, to allow said auxiliary hand grip to be solidly attached to said barrel of said handle member, and to prevent said auxiliary hand grip from being rotated relative to said handle member.

5. The tool handle as claimed in claim 1, wherein said auxiliary hand grip includes a spring member attached to said stem, and engageable with said barrel, to stably attach said auxiliary hand grip to said barrel of said handle member.

6. The tool handle as claimed in claim 5, wherein said spring member includes a peripheral wall engaged onto said stem, to stably attach said spring member to said stem of said auxiliary hand grip.

7. The tool handle as claimed in claim 6, wherein said stem includes at least one outer peripheral groove formed therein, and said spring member includes a peripheral rib extended inwardly from said peripheral wall and engaged into said at least one outer peripheral groove of said stem, to stably attach said spring member to said stem of said auxiliary hand grip.

8. The tool handle as claimed in claim 1, wherein said auxiliary hand grip includes an outer peripheral fence extended therefrom, and located around said stem, to form a peripheral recess between said outer peripheral fence and said stem, and to receive said barrel and said primary hand grip.

9. The tool handle as claimed in claim 8, wherein said primary hand grip includes a peripheral flange extended rearwardly therefrom, and having an outer diameter smaller than that of said primary hand grip, to form a peripheral shoulder between said peripheral flange and said primary hand grip, said peripheral flange is engaged into said peripheral recess of said auxiliary hand grip, and said outer peripheral fence of said auxiliary hand grip is engaged into said peripheral shoulder of said primary hand grip.

10. The tool handle as claimed in claim 1, wherein said auxiliary hand grip includes a chamber formed therein, and a tool holder received in said chamber of said auxiliary hand grip.

11. The tool handle as claimed in claim 10, wherein said tool holder includes a plurality of orifices formed therein, for receiving tool members therein.

12. The tool handle as claimed in claim 11, wherein said tool holder includes a plurality of slits formed therein, and communicating with said orifices thereof, to resiliently clamping and retaining said tool members to said tool holder.

13. The tool handle as claimed in claim 11, wherein said tool holder includes a spring member engaged thereon to clamp and retain said tool members to said tool holder.

14. The tool handle as claimed in claim 13, wherein said tool holder includes an outer peripheral slot formed therein, to receive said spring member.

15. The tool handle as claimed in claim 10, wherein said auxiliary hand grip includes a cover attached thereto, to enclose said chamber thereof, and to stably retain said tool holder in said chamber of said auxiliary hand grip.

* * * * *